US005465696A

United States Patent [19]

Gmelin

[11] Patent Number: 5,465,696

[45] Date of Patent: Nov. 14, 1995

[54] THROTTLE APPLIANCE FOR AN INTERNAL COMBUSTION ENGINE AND METHOD OF MANUFACTURING METERING WALLS IN THE THROTTLE APPLIANCE

[75] Inventor: Karl Gmelin, Flein, Germany

[73] Assignee: Robert Bosch GmbH, Stuttgart, Germany

[21] Appl. No.: 256,836

[22] PCT Filed: Nov. 10, 1993

[86] PCT No.: PCT/DE93/01069

§ 371 Date: Jul. 28, 1994

§ 102(e) Date: Jul. 28, 1994

[87] PCT Pub. No.: WO94/12781

PCT Pub. Date: Jun. 9, 1994

[30] Foreign Application Priority Data

Nov. 28, 1992 [DE] Germany ..... 42 40 127.5

[51] Int. Cl.[6] ..... F02D 9/10

[52] U.S. Cl. ..... 123/337; 251/305

[58] Field of Search ..... 123/337, 403; 251/305

[56] References Cited

U.S. PATENT DOCUMENTS

| | | | |
|---|---|---|---|
| 4,391,247 | 7/1983 | Shioyama et al. | 123/403 |
| 4,474,150 | 10/1984 | Foley et al. | 123/337 |
| 4,905,647 | 3/1990 | Kizer et al. | 123/337 |
| 5,315,975 | 5/1994 | Hattori et al. | 123/337 |
| 5,374,031 | 12/1994 | Semence et al. | 123/337 |

FOREIGN PATENT DOCUMENTS

| | | |
|---|---|---|
| 109792 | 5/1984 | European Pat. Off. . |
| 433518 | 6/1991 | European Pat. Off. . |
| 2575518 | 7/1986 | France . |
| 2650360 | 2/1991 | France . |

*Primary Examiner*—Willis R. Wolfe

*Attorney, Agent, or Firm*—Edwin E. Greigg; Ronald E. Greigg

[57] ABSTRACT

A throttle appliances in which induction ducts are configured off-set with respect to the pivoting region of throttle elements, such that metering walls that are provided influence the air throughput at small opening angles of the throttle element in an optimum manner. The throttle appliance is characterized by its extremely accurately matched metering walls in a range of small opening angles of the throttle butterfly in the induction duct. The metering walls are achieved by a method of displacing a rotating chip-cutting element with its center (M) on a previously calculated path (B) in the induction duct in the axial direction with a radial offset. This method permits the manufacture of varied contours of metering walls in order to achieve desired air throughput/opening angle characteristics. The throttle appliance is usually employed in internal combustion engines which are preferably used in motor vehicles.

4 Claims, 1 Drawing Sheet

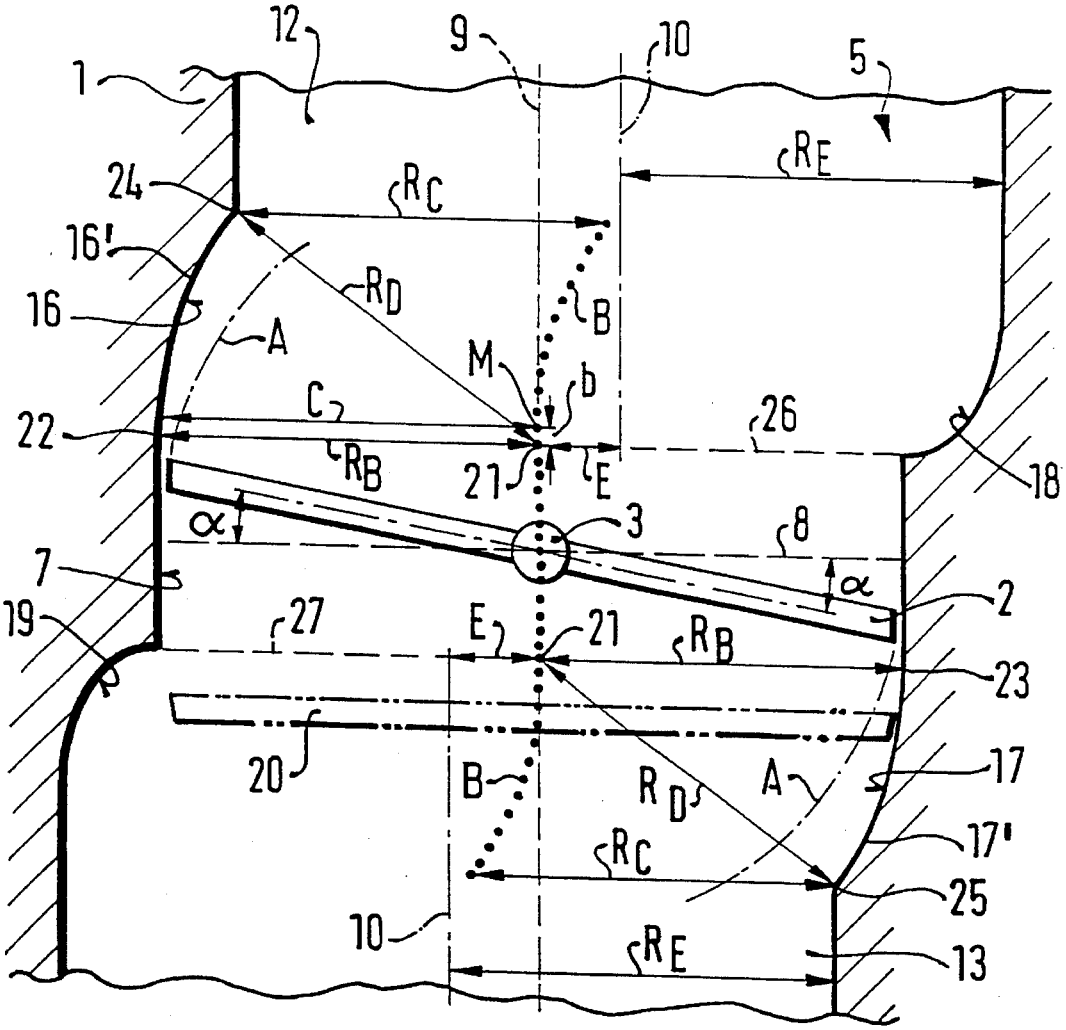
12
9
10
5
1
$R_E$
24
$R_C$
16'
$R_D$
B
16
A
M
b
C
26
22
$R_B$
21
E
18
3
8
α
7
α
2
19
27
E
21
$R_B$
23
20
B
$R_D$
A
17
17'
$R_C$
25
10
$R_E$
13

THROTTLE APPLIANCE FOR AN INTERNAL COMBUSTION ENGINE AND METHOD OF MANUFACTURING METERING WALLS IN THE THROTTLE APPLIANCE

PRIOR ART

The invention is based on a throttle appliance for an internal combustion engine and a method of manufacturing metering or apportioning walls in the throttle appliance. A throttle appliance for internal combustion engines (German Offenlegungsschrift 30 38 945, U.S. Pat. No. 4,391,247) is already known in which a throttle element is arranged in an induction duct, the throttle element moving in its rotational range relative to metering or apportioning walls of the induction duct in such a way that the air quantity flowing past and between the throttle element and the metering or apportioning walls is limited during the opening of the throttle element. Up to an opening angle of the throttle element of approximately 40°, the air quantity flowing past increases steadily to an extent which is only slight with an increasing opening angle, whereas at opening angles becoming greater than approximately 40°, a steep increase in the air flow quantity per increase in opening angle takes place because the throttle element moves out of the region of the metering or apportioning walls. The metering or apportioning walls of the induction duct have a spherical configuration around centres which are located on the periphery of a throttle butterfly shaft. Exact metering in the range of throttle element opening angle between 0° and 40° is not possible due to the constant radii, starting from the centres on the periphery of the throttle butterfly shaft, of the metering or apportioning walls of the induction duct. Also disadvantageous with this arrangement is the complicated machining of the metering or apportioning walls in the induction duct because the casing has to be pivoted in order to achieve a spherical shape of the metering or apportioning walls.

ADVANTAGES OF THE INVENTION

The throttle appliance, according to the invention has an advantage that extremely accurate metering of the air quantity flowing past the throttle element is achieved in the range of opening angles of, for example, 0° to 40° without additional complicated arrangements, for example gears, for setting desired opening angles of the throttle element. For this purpose, the induction duct has, in the region of opening angles from 0° to 40° of the throttle element, metering or apportioning walls whose contours are produced by a method of displacing the centres of a chip-cutting element on a previously calculated path in the induction duct. This method of manufacturing the metering or apportioning walls of the induction duct has the advantage that the metering or apportioning walls no longer have to be made spherical. On the contrary, contours of the metering or apportioning walls are achieved which depart from a spherical shape and, for example, follow as a parallel contour at a constant distance from the contour of the centres of the chip-cutting element or even become more distant, in a previously calculated manner, from the contour of the centers of the chip-cutting element by means, for example, of a continually increasing radius of rotation of the chip-cutting element. The possibilities for varying the introduction of the contours of the metering or apportioning walls of the induction duct are therefore advantageous, these possibilities permitting the creation of throttle appliances in which very accurate metering of the air flow in the induction duct takes place within each individual angular range at small opening angles of the throttle element.

In addition to the obviation of gears for improving the progression of the opening characteristic of the throttle element relative to the metering or apportioning walls, in order to achieve very accurate metering of the air flow in the induction duct, it is particularly advantageous that a simple return spring mechanism can be used for moving the throttle element in the direction of the closed position.

It is furthermore of advantage that the throttle element has an oval configuration. In a cylindrical region of the induction duct, the throttle element is, namely, tightly fitted at an angle to the horizontal plane in the induction duct of, for example, 3° to 5°; this position corresponds to the closed position of the throttle element. The oval shape of the throttle element prevents jamming of the throttle element in the induction duct. The throttle element appears circular in the projection of the throttle element in the horizontal plane of the induction duct.

Advantageous further developments and improvements to the method of manufacturing a throttle appliance given in claim 2 are possible by means of the measures listed in the subclaims.

DRAWING

An embodiment example of the invention is shown in a simplified manner in the drawing and is explained in more detail in the following description.

DESCRIPTION OF THE EMBODIMENT EXAMPLE

The invention relates to a throttle appliance with an induction duct 5 and a throttle butterfly 2 arranged within it, metering or apportioning walls 16 and 17 of the induction duct 5 having a specially configured contour in the pivoting range of the throttle butterfly 2 in order to influence the air flow in the induction duct 5 very accurately. The induction duct 5 of the throttle appliance is connected downstream to an induction conduit of an internal combustion engine. The throttle appliance according to the invention is represented diagrammatically in the drawing. In this, accurate representation of a casing 1, of the fastening of the throttle butterfly 2 in a throttle butterfly shaft 3 and of the fastening of the throttle butterfly shaft 3 in the casing 1 is omitted because these elements of the throttle appliance correspond to the prior art.

Within the, for example, circular but stepped induction duct 5 is located the ellipse-shaped throttle butterfly 2 which controls the air flow in the induction duct 5 of the internal combustion engine, which is not described in any more detail. The throttle butterfly 2, with the throttle butterfly shaft 3, is arranged in a cylindrical region 7 of the induction duct 5, the throttle butterfly 2 forming, in the closed position, an angle $\alpha$ of between 3° and 5° relative to a horizontal plane 8, which extends through the throttle butterfly shaft 3 and divides the cylindrical region 7 axially in the centre. The throttle butterfly 2 does not therefore protrude in the axial direction out of the cylindrical region 7. The throttle butterfly 2 is embodied in oval or elliptical shape for tight fitting of the throttle butterfly 2 in the cylindrical region 7 of the induction duct 5, in order to achieve the angle $\alpha$ of between 3° and 5° in the closed position of the throttle butterfly 2 and therefore to avoid jamming of the throttle butterfly 2 in the cylindrical region 7. The projection of the oval throttle butterfly 2 in the horizontal plane 8 of the induction duct 5 gives a circular throttle butterfly 2.

A longitudinal axis 9 extends centrally through the cylindrical region 7 of the induction duct 5, in which the throttle butterfly 2 is completely located in the closed position. This longitudinal axis 9 extends eccentrically in both directions in the circular regions 12 and 13 of the induction duct 5 located axially upstream and downstream of the cylindrical region 7. The centre lines 10, represented as chain-dotted lines, of the regions 12 and 13 of the induction duct 5 lying outside the cylindrical region 7 are respectively located at a distance to the right and left of the longitudinal axis 9 by the dimension of an offset E. The radial extent of the cylindrical region 7 is characterized by the dimension of a radius $R_B$. The radius $R_B$ of the cylindrical region 7 is selected in such a way that it is slightly larger than the radius of the circular throttle butterfly 2 projected into the horizontal plane 8 so that a slight intermediate space is formed between the induction duct 5 and the throttle butterfly 2. The regions 12 and 13 of the induction duct 5 have radii $R_E$ which are either larger than the radius $R_B$ or correspond exactly to the dimension of the radius $R_B$. The total radial extent of the induction duct 5 upstream and downstream of the throttle butterfly 2 is formed by twice the radius $R_E$ and twice the offset E.

Metering or apportioning walls 16 and 17 adjoin directly upstream and downstream the cylindrical region 7 of the induction duct 5. The metering or apportioning walls 16 and 17 are respectively configured in their periphery over, for example, 180°, the metering or apportioning wall 16 being located on the opposite side of the induction duct 5 relative to the metering or apportioning wall 17. The metering or apportioning walls 16 and 17 form, for example over 180° of their periphery, the connecting pieces of the induction duct 5 between the cylindrical region 7 and the regions 12 and 13, which have, for example, circular cross sections. The unmachined duct sections 18 and 19, retaining the original cast contour, follow the metering or apportioning walls 16 and 17 over the rest of the periphery, the size of the periphery of which duct sections 18 and 19 being determined by the peripheries of the metering or apportioning walls 16 and 17 and being likewise, for example, 180°. The duct sections 18 and 19 can be left in their unmachined form because the contours of the duct sections 18 and 19 of the induction duct 5 play no role in the air throughput per opening angle of the throttle butterfly 2 and therefore in the air characteristic.

The metering or apportioning walls 16 and 17 are intended to contribute to the most accurate possible metering of the air quantity flowing past the throttle butterfly 2, principally in the range of opening angles up to 40°. In order to ensure accurate matching of the air throughput to previously determined air characteristics, the contours of the metering or apportioning walls 16 and 17 are generated by means of a method using a chip-cutting element 20, for example a lathe tool. The lathe tool 20, which is represented diagrammatically by a double-dot, chain-dotted line, then rotates about a lathe tool centre M, the lathe tool centre M being displaced in the axial and radial direction in accordance with a previously calculated locus B which is characterized by a dotted line. The dotted line characterizing the locus B passes through intersection points 21 between the longitudinal axis 9 and the horizontal planes 26 and 27 bounding the cylindrical region 7.

The locus B of the dotted line is calculated in such a way that contours 16' and 17', matched to the requirements of the internal combustion engine, of the metering or apportioning walls 16 and 17 are initially specified in a plane extending at right angles to the throttle butterfly shaft 3 and through the longitudinal axis 9; this plane corresponds to the plane of the drawing. Hypothetical cutting planes are subsequently generated at right angles to the longitudinal axis 9 at specified, almost infinitely small, axial distances b. A radial distance c is subtracted from the intersection point of each of these cutting planes with the contours 16' and 17' of the metering or apportioning walls 16 and 17 in the direction towards the longitudinal axis 9, which radial distance c can be equal to or not equal to the radius $R_B$. The radial distance c starting from the contours 16' and 17' of the metering or apportioning walls 16 and 17 ends in the respective lathe tool centre M. The sequence of the lathe tool centres M fixed by this means in the individual cutting planes at the axial distances b is the locus B represented by the dotted line. In order to generate the stepless, three-dimensional contours of the metering or apportioning walls 16 and 17, the lathe tool 20 is displaced, while rotating, in the axial and radial direction along the locus B.

The machining of the casing 1 to create the desired contours of the metering or apportioning walls 16 and 17 does not, therefore, take place from a fixed point in the induction duct 5. At the respective starts 22 and 23, facing towards the cylindrical region 7, of the metering or apportioning walls 16 and 17, the lathe tool 20 rotates with a radius which corresponds exactly to the dimension of the radius $R_B$ of the cylindrical region 7. The contours of the metering or apportioning walls 16 and 17 are now generated by the lathe tool 20 being displaced in sufficiently small steps axially and with radial offsets, the lathe tool centres M following the locus B. It can also be envisaged that the contours of the metering or apportioning walls 16 and 17 are achieved by almost infinitely many, axially narrow cylinders being generated by the lathe tool 20 between the cutting planes (mentioned above) at the axial distances b, these narrow cylinders having a minimum radial offset relative to one another and their peripheries providing the stepless, three-dimensional contours of the metering or apportioning walls 16 and 17 over, for example, 180°.

It is useful to leave the radius of the lathe tool 20 constant, e.g. at the size of the radius $R_B$, during the machining of the metering or apportioning walls 16 and 17, so that the contours 16' and 17' of the metering or apportioning walls 16 and 17 represent contours parallel to the locus B of the lathe tool centres M. At ends 24 and 25 of the metering or apportioning walls 16 and 17 remote from the cylindrical region 7, the lathe tool 20 rotates with a radius $R_C$. If a contour parallel to the locus B of the lathe tool centres M is to be created, $R_B=R_C$ applies, i.e. it is possible to machine at constant radius with a lathe tool 20. It is likewise conceivable to let the dimension of the radius $R_C$ deviate from the radius $R_B$, If widening is desired, i.e. the distance between the locus B of the lathe tool centres M and the contours 16' and 17' of the metering or apportioning walls 16 and 17 is to become greater in the directions facing away from the cylindrical region 7, correspondingly larger radial distances c must be used; $R_C>R_B$ applies. The radial widening per axial displacement part can then take place continuously but not necessarily linearly. Furthermore, it is possible to let the radial distance c between the locus B of the lathe tool centres M and the contours 16' and 17' of the metering or apportioning walls 16 and 17 become smaller in the directions facing away from the cylindrical region 7. In this case, $R_C<R_B$ applies.

Due to the axial displacement of the lathe tool centres M with a small radial offset along the locus B, contours of the metering or apportioning walls 16 and 17 will usually appear which have a shape deviating from a sphere. A dimension $R_D$, which represents the distances between the ends 24 and 25 of the metering or apportioning walls 16 and 17 and the intersection points 21 between the longitudinal axis 9 and the planes 26 and 27 horizontally terminating the cylindrical region 7, will usually deviate from the dimension $R_B$. A special case is provided by $R_B=R_D$ because, in this case, the cylinders generated by the lathe tools 20 are displaced in precisely such a way that the metering or apportioning walls 16 and 17 take on a spherical shape in the plane of the drawing.

All these different variants of the contours of the metering or apportioning walls 16 and 17 can be simply achieved by the method of displacing the lathe tool centres M on previously calculated paths in the induction duct 5. For this purpose, a known programmable lathe is used. The periphery of the throttle butterfly 2 moves along a path A characterized by a chain-dotted line. The distance per opening angle between the paths A and the metering or apportioning walls 16 and 17 is altered continuously, but not necessarily linearly, in accordance with the requirements of the internal combustion engine when the induction duct 5 is opened by moving the throttle butterfly 2 out of its closed position. The metering or apportioning walls 16 and 17 can even be shaped in such a way that they extend almost parallel to the paths A of the throttle butterfly 2 so that the increase in the air throughput per opening angle of the throttle butterfly 2 is extremely minimal.

When operating the internal combustion engine in the lower part-load range, i.e. with only a slightly opened induction duct 5 and a slight opening angle of the throttle butterfly 2, very good meterability is achieved by this means even in the case of throttle butterflies 2 of large diameter.

I claim:

1. A throttle appliance for an internal combustion engine with a casing, an induction duct extending in the casing, a throttle butterfly shaft rotatably supported in the casing and protruding transversely through the induction duct and a throttle butterfly fastened to the throttle butterfly shaft in the induction duct, the induction duct (5) has a cylindrical region (7) with a longitudinal axis (9), the throttle butterfly (2) is embodied in oval shape and in a closed position is located completely in said cylindrical region (7), metering walls (16, 17) follow upstream and downstream of the cylindrical region (7), which determines the air throughput in the induction duct (5) because of their contours due to an interaction with the throttle butterfly (2) on opening of the latter, the contours of the metering walls (16, 17) following at an increasing distance a path (A) of a periphery of the throttle butterfly (2) in order to achieve a slight and well-metered increase in the air quantity with an increasing opening angle of the throttle butterfly (2), and the metering walls (16, 17) are machined by a chip-cutting rotating element (20), the rotation of the chip-cutting element (20) taking place about a center (M) which is moved radially and axially along a previously calculated locus (B) which deviates from a longitudinal axis (9).

2. A method of forming an induction duct including a central region (7) which includes a throttle butterfly (2) operative on a shaft (3) and metering walls (16, 17) on opposite ends of said central region in which said metering walls are offset axially right and left from an axis of said central region, which comprises generating contours of said metering walls (16, 17) with contours (16', 17') which are matched to requirement of an internal combustion engine specified in a plane extending at right angles to the throttle butterfly shaft (3) and through a longitudinal axis (9) through the central region (7), determining hypothetical cutting planes at right angles to the longitudinal axis (9) generated at infinitely small axial distances (b), a radial distance (c) is subsequently subtracted from the intersection point of each of these cutting planes with the contours (16', 17') of the metering walls (16, 17) in the direction towards the longitudinal axis (9), which radial distance (c) can be equal to or not equal to a radius ($R_B$) of the cylindrical region (7) and, starting from the contours (16', 17') of the metering walls (16, 17), ends in the respective center (M) about which the rotation of a chip-cutting element (20) takes place; the centers (M) determined in this manner in the individual cutting planes with the axial distances (b) give the locus (b); and finally, in order to generate the stepless, three-dimensional contours of the metering walls (16, 17), the chip-cutting element (20) is displaced, while rotating, in the axial and radial direction along the locus (b) of the center points (M).

3. A method according to claim 2, in which the contours of the metering walls (16, 17) are produced by a constant size chip-cutting element (20) and, therefore, the contours of the metering walls (17, 17) represent contours parallel to the locus (b) of the centers (M) of the chip-cutting element (20).

4. A method according to claim 2, in which the manufacture of the contours of the metering walls (16, 17) takes place in such a way that the radial distance (c) between the center (M) of rotation and the metering walls (16, 17) is variable so that the locus (b) of the centers (M) and the contours of the metering walls (16, 17) do not extend parallel to one another.

* * * * *